US007673704B2

(12) United States Patent
Phan et al.

(10) Patent No.: US 7,673,704 B2
(45) Date of Patent: Mar. 9, 2010

(54) VARIABLE POSITIONING DEEP CUTTING ROTARY CORING TOOL WITH EXPANDABLE BIT

(75) Inventors: Quan V. Phan, Houston, TX (US); Borislav J. Tchakarov, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 312 days.

(21) Appl. No.: 11/601,403

(22) Filed: Nov. 17, 2006

(65) Prior Publication Data

US 2008/0078582 A1 Apr. 3, 2008

Related U.S. Application Data

(63) Continuation-in-part of application No. 11/540,032, filed on Sep. 29, 2006.

(51) Int. Cl.
*E21B 47/00* (2006.01)

(52) U.S. Cl. ..... 175/20; 175/58

(58) Field of Classification Search ..... 175/20, 175/58, 387, 403

See application file for complete search history.

(56) References Cited

U.S. PATENT DOCUMENTS 2,599,770 A * 6/1952 Marcerou ..... 408/59
3,272,268 A * 9/1966 Tricon et al. ..... 175/4
4,969,528 A * 11/1990 Jurgens ..... 175/58
6,371,221 B1 4/2002 Harrigan et al.
6,550,549 B2 4/2003 Myrick
6,953,096 B2 10/2005 Gledhill et al.
2004/0007387 A1 1/2004 Bar-Cohen
2005/0284629 A1 12/2005 Reid et al.
2005/0284829 A1 12/2005 Shaffer
2008/0135299 A1* 6/2008 Fields et al. ..... 175/58

* cited by examiner

*Primary Examiner*—William P Neuder
(74) *Attorney, Agent, or Firm*—Mossman Kumar & Tyler PC

(57) ABSTRACT

A coring device includes a primary and a secondary bit that drill a first and second depth into a formation, respectively. The first and second bits are positioned on telescopically arranged mandrels that are rotated by a suitable rotary drive. The coring tool also includes a drive device that extends the first bit and the second bit a first depth into the formation and extends only the second bit a second depth into the formation. In arrangements, the actuating device can include a first hydraulic actuator applying pressure to extend the second bit into the formation and a second hydraulic actuator applying pressure to retract the second bit from the formation. The advancement and retraction of the first and second bits can be controlled by a control unit that uses sensor signals, timers, preprogrammed instruction and any other suitable arrangement.

20 Claims, 9 Drawing Sheets

VARIABLE POSITIONING DEEP CUTTING ROTARY CORING TOOL WITH EXPANDABLE BIT

CROSS-REFERENCE TO RELATED APPLICATIONS

This application is a continuation-in-part of U.S. patent application Ser. No. 11/540,032 filed on Sep. 29, 2006.

BACKGROUND OF THE INVENTION

1. Field of the Invention

This invention relates to the testing and sampling of underground formations or reservoirs. More particularly, this invention relates to a method and apparatus for isolating a layer in a downhole reservoir, testing the reservoir formation, analyzing, sampling, storing a formation fluid, coring a formation, and/or storing cores in a formation fluid.

2. Description of the Related Art

Hydrocarbons, such as oil and gas, often reside in porous subterranean geologic formations. Often, it can be advantageous to use a coring tool to obtain representative samples of rock taken from the wall of the wellbore intersecting a formation of interest. Rock samples obtained through side wall coring are generally referred to as "core samples." Analysis and study of core samples enables engineers and geologists to assess important formation parameters such as the reservoir storage capacity (porosity), the flow potential (permeability) of the rock that makes up the formation, the composition of the recoverable hydrocarbons or minerals that reside in the formation, and the irreducible water saturation level of the rock. These estimates are crucial to subsequent design and implementation of the well completion program that enables production of selected formations and zones that are determined to be economically attractive based on the data obtained from the core sample.

The present invention addresses the need to obtain core samples more efficiently, at less cost and at a higher quality that presently available.

SUMMARY OF THE INVENTION

In aspects, the present invention provides systems, devices, and methods to retrieve samples such as cores and fluid samples from a formation of interest. In one embodiment, the coring device includes a primary or first bit that drills a first depth into the formation and a secondary or second bit that drills a second depth into the formation. The first and second bits can be positioned on telescopically arranged mandrels that are rotated by a suitable rotary drive. The coring tool also includes a drive device that extends the first bit and the second bit to a first depth into the formation and extends only the second bit to a second depth into the formation. A bit box advances the first bit and the second bit to the first depth. The bit box can utilize known hydraulic or electro-mechanical devices. The second bit can be advanced to the second depth by an actuating device. In arrangements, the actuating device can include a first hydraulic actuator applying pressure to extend the second bit into the formation and a second hydraulic actuator applying pressure to retract the second bit from the formation.

During use, the coring tool is positioned in the wellbore adjacent a formation of interest. The coring tool can be anchored in the wellbore at a selected radial position by actuating decentralizing arms and an annular isolation zone can be formed by energizing spaced apart packers. Thereafter, a rotary drive device such as an electric motor rotates the first and second bit via a shaft and suitable gear transmission system. With the first and second bits rotating, the bit box advances the first and second coring bits to the first depth. Once the mandrel carrying the first coring bit reaches its maximum outward stroke, the actuating device applies hydraulic pressure to the mandrel carrying the second coring bit to advance the second coring bit to the second depth. Once the mandrel carrying the second bit reaches its maximum stroke, the core is broken and the actuating device applies hydraulic pressure to retract this mandrel containing the core. The advancement and retraction of the first and second bits can be controlled by a control unit that uses sensor signals, timers, preprogrammed instruction and any other suitable arrangement. The coring activity can be performed in an at-balanced, underbalanced, or overbalanced condition. Additionally, the coring sample can be retained in a pristine formation fluid.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
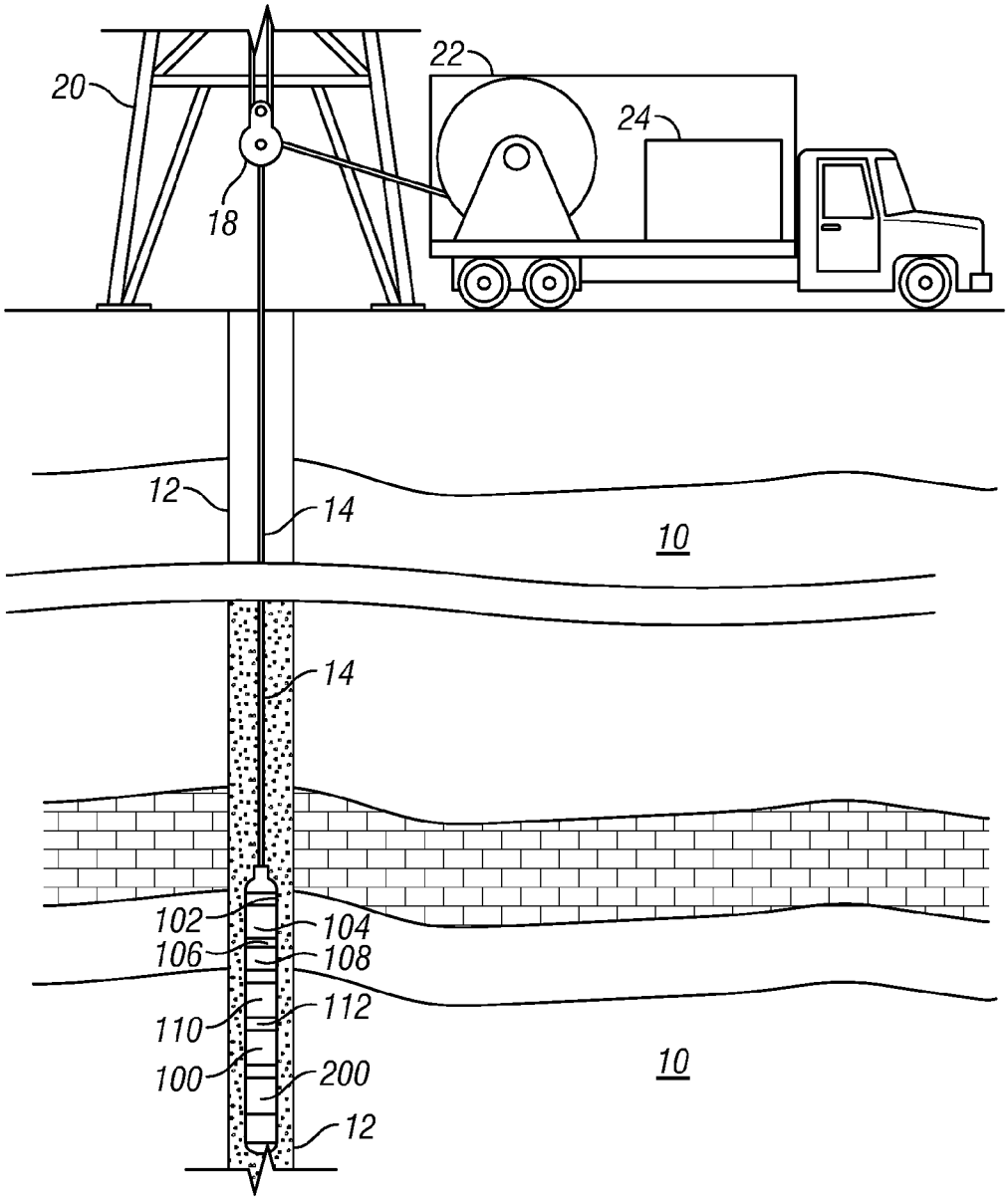
FIG. 1 schematically illustrates a sectional elevation view of a sectional elevation view of a system utilizing a formation sampling device made in accordance with one embodiment of the present invention.

The present invention relates to devices and methods for obtaining formation samples, such as core samples and fluid samples, from subterranean formations. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. Indeed, as will become apparent, the teachings of the present invention can be utilized for a variety of well tools and in all phases of well construction and production. Accordingly, the embodiments discussed below are merely illustrative of the applications of the present invention.

Referring initially to FIG. 1, there is schematically represented a cross-section of subterranean formation 10 in which is drilled a wellbore 12. Usually, the wellbore will be at least partially filled with a mixture of liquids including water, drilling fluid, and formation fluids that are indigenous to the earth formations penetrated by the wellbore. Hereinafter, such fluid mixtures are referred to as "wellbore fluids". The term "formation fluid" hereinafter refers to a specific formation fluid exclusive of any substantial mixture or contamination by fluids not naturally present in the specific formation. Suspended within the wellbore 12 at the bottom end of a wireline 14 is a formation sampling tool 100. The wireline 14 is often carried over a pulley 18 supported by a derrick 20. Wireline deployment and retrieval is performed by a powered winch carried by a service truck 22, for example. A control panel 24 interconnected to the tool 100 through the wireline 14 by conventional means controls transmission of electrical power, data/command signals, and also provides control over operation of the components in the formation sampling tool 100. As will be discussed in greater detail below, the tool 100 is fitted with equipment and tool that can enable the sampling of formation rock, earth, and fluids under a variety of conditions.

Figure 2:
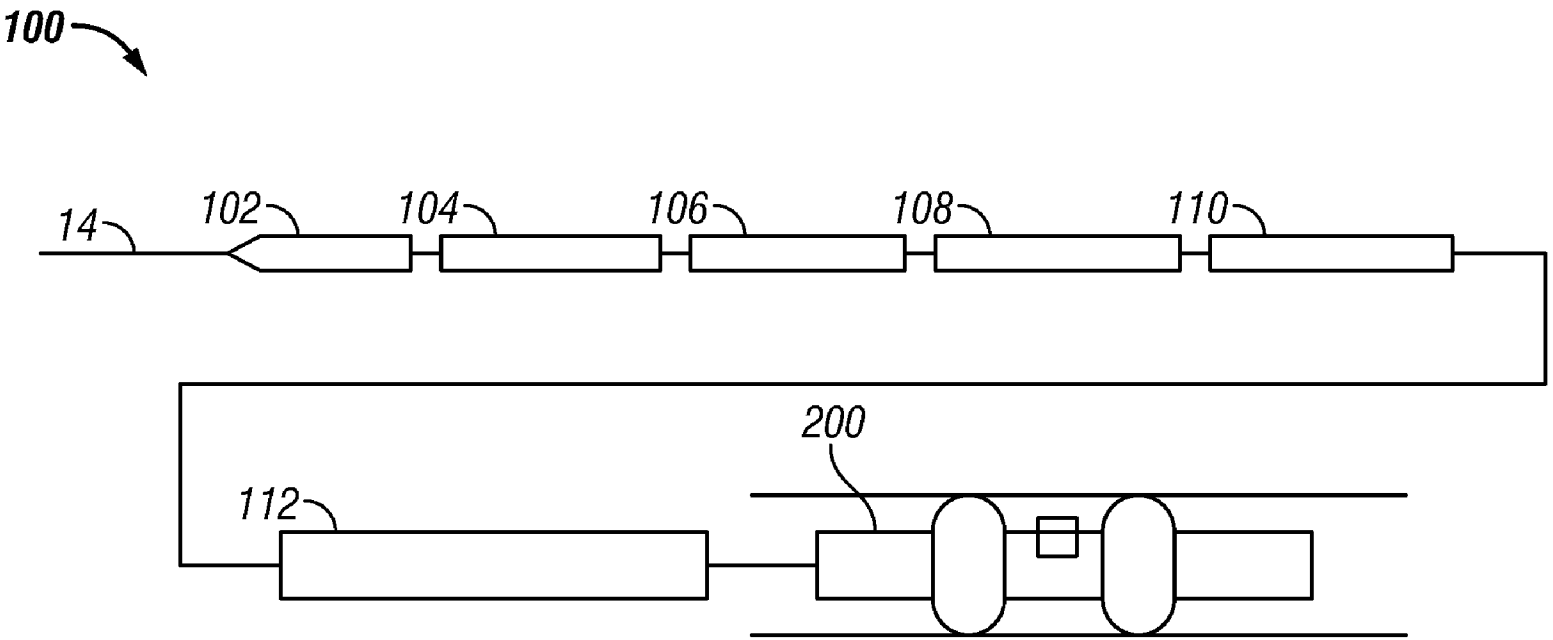
FIG. 2 schematically illustrates a formation sampling tool made in accordance with one embodiment of the present invention.

Referring now to FIG. 2, there is schematically illustrated one embodiment of a formation sampling tool 100 that can retrieve one or more samples, such as fluid and/or core samples, from a formation. The tool 100 includes a cable head 102 that connects to the wireline 14, a plurality of modules 104 and 106, an electronics module 108, a hydraulics module 110, a formation testing module 112 and a coring module 200. The formation testing module 112 is configured to retrieve and store fluid samples and the coring module 200 is configured to retrieve and store core samples in formation fluid. The modules 112 and 200 can also include analysis tools that perform downhole testing on the retrieved samples. The hydraulics module 110 provides hydraulic fluid for energizing and operating the modules 112 and 200 and can include pumps, accumulators, and related equipment for furnishing pressurized hydraulic fluid. The electronics module 108 includes suitable circuitry, controllers, processors, memory devices, batteries, etc. to provide downhole control over the sampling operations. The electronics module 108 can also include a bi-directional communication system for transmitting data and command signals to and from the surface. Exemplary equipment in the electronics module 108 can include controllers pre-programmed with instructions, bi-directional data communication equipment such as transceivers, A/D converters and equipment for controlling the transmission of electrical power. It should be appreciated that the modular nature of the tool 100 can simplify its construction, e.g., two or more sampling modules, such as modules 112 and 200, can share the same electronics and hydraulics. Moreover, the tool 100 can be configured as needed to accomplish specific desired operations. For instance, the modules 104 and 106 can be utilized to house additional tools, such as survey tools, formation evaluation tools, reservoir characterization tools, or can be omitted if not needed. Therefore, it should be understood that the formation testing module 112 and the coring module 200 are merely some of the tools and instruments that could be deployed with the tool 100.

Figure 3:
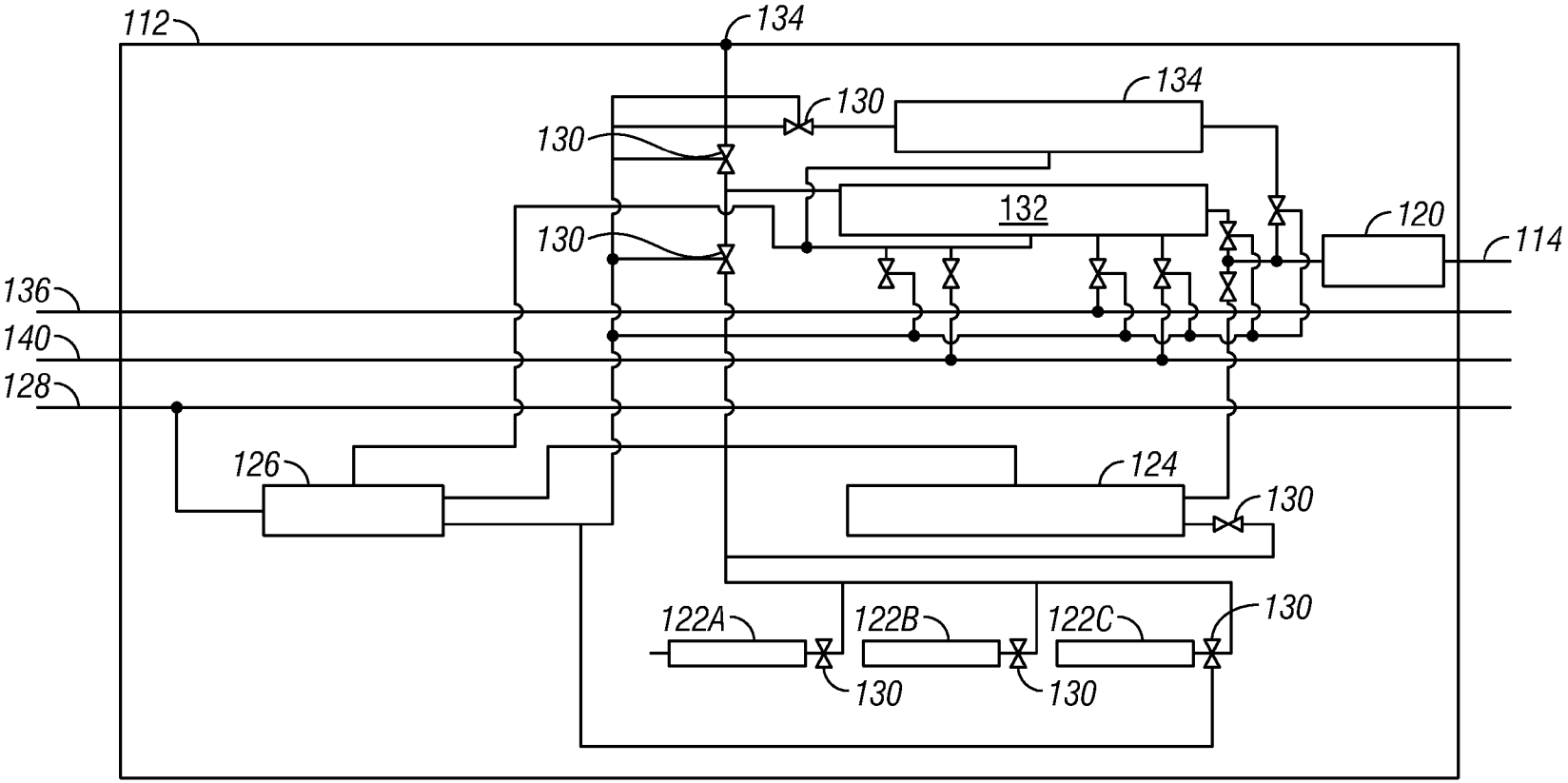
FIG. 3 schematically illustrates a fluid sampling device made in accordance with one embodiment of the present invention.
Figure 4:
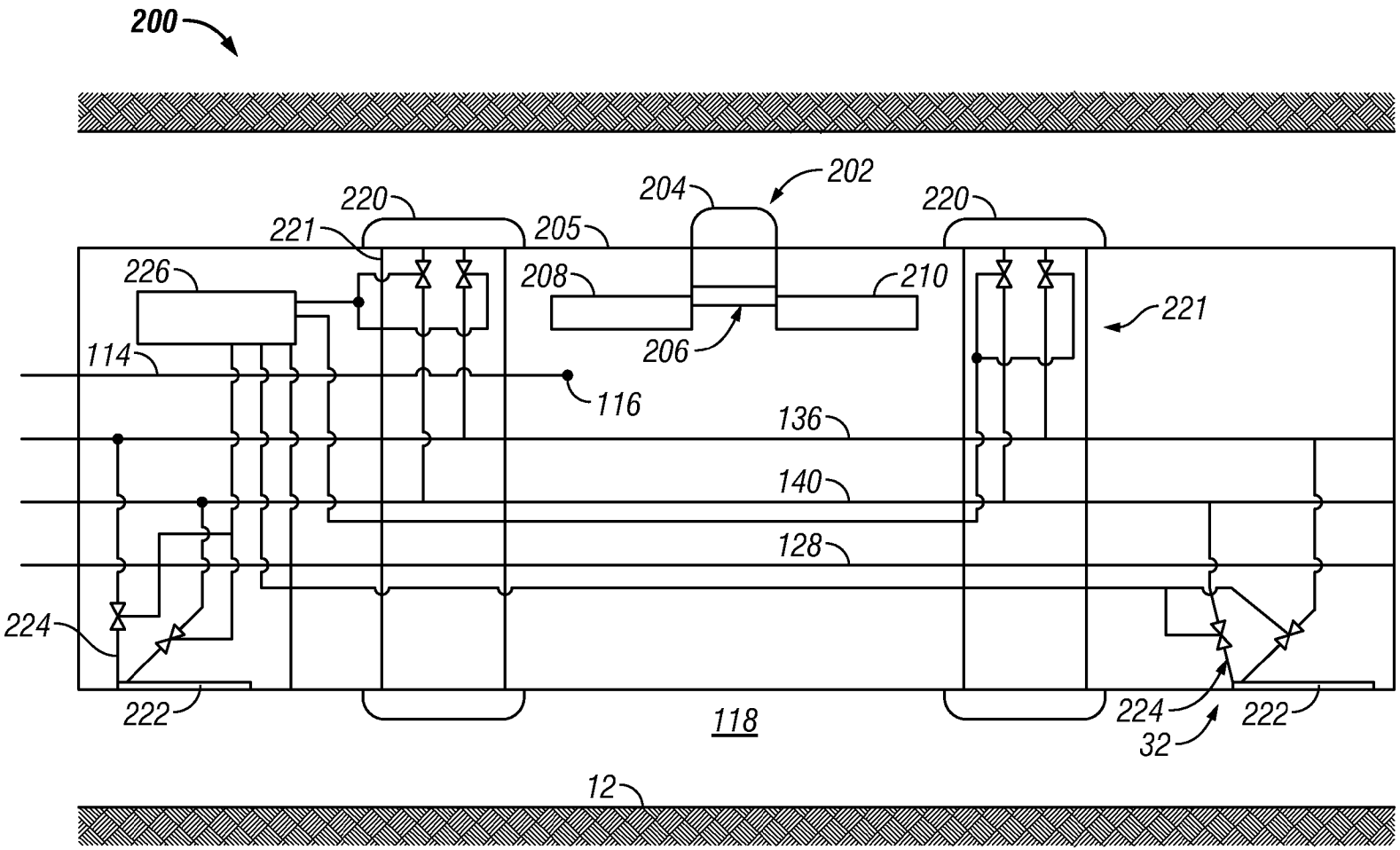
FIG. 4 schematically illustrates a coring device made in accordance with one embodiment of the present invention.

Referring now to FIGS. 3 and 4, the formation testing module 112 is configured to measure a formation pressure precisely, and to receive, analyze and/or store fluids retrieved from a formation. The module 112 retrieves fluid using a flow device such as a drawdown pump 134 that is connected to one or more sampling lines 114 that terminate at the coring module 200. For example, an illustrative sample line 114 can terminate at an opening 116 on the coring module 200. The opening 116 retrieves fluid in an annular space 118 surrounding the coring module 200. In one embodiment, the opening 116 is positioned at or near the top of the annular space 118 and has a filter (not shown) to prevent cuttings or debris from going into the formation testing module 112. Also, the drawdown pump 134 can provide bi-directional flow, which allows the filter (not shown) to be flushed out and cleaned prior to reuse. The retrieved fluid is analyzed by one or more formation characterization sensors 120, e.g., Sample View and RC sensors available from Baker Hughes Incorporated, and eventually stored in a bank of sample carriers 122*a-c*. Prior to or during storage, suitable sensors such as pressure gauges 124 are used to monitor selected fluid parameters, to evaluate sample characteristics, and to determine sample quality for the retrieved fluid. Control over the fluid retrieval process is provided by a module control manifold 126 that is connected to a power/communication bus 128 leading to the electronics module 108 (FIG. 2). In one arrangement, the control manifold 126 is operatively connected to flow control devices such as valves, some representative valves being labeled with numeral 130. The control manifold 126 can also control pump devices such as a pump thru module 132 and a drawdown module 134. One exemplary formation and reservoir characterization instrument is RCI$^{SM}$ available from Baker Hughes Incorporated. Exemplary formation analysis modules also include SampleView$^{SM}$, which provides real-time, near-infrared spectra of a formation fluid pumped from the formation and can be used to assess fluid type and quality downhole, an R/C sensor that comprises resistivity and fluid capacitance positioned on the flowline to determine the fluid type.

Referring now to FIG. 4, there is schematically shown one embodiment of a coring module 200 that retrieves core samples from the formation. The coring module 200 uses a coring device 202 for extracting a core sample from a formation. In one embodiment, the coring device 202 includes coring bit 204 and a bit drive 208 consisting of motor and transmission for rotationally turning the coring bit. A bit box 206 deploys and retracts the coring bit 204 into the formation and applies the necessary force on the bit to perform the coring function, and a core container 210 for receiving and storing the cores. In one embodiment, the coring bit 204 is mounted on the end of a cylindrical mandrel (not shown) mounted within the bit box 206. The bit box 206 provides lateral movement with respect to the longitudinal axis of the module 200. The mandrel (not shown) is hollow for accepting the drilled core sample and retaining the core sample during the retracting operation of the coring bit 204. A drive motor (not shown) for rotating the coring bit 204 is preferably a high torque, high speed DC motor or a low speed high torque hydraulic motor and can include suitable gearing arrangements for gearing up or down the drive speed imparted to a drive gear (not shown). The coring device 202 can utilize a self-contained power system, e.g., a hydraulically actuated motor, and/or utilize the hydraulic fluid supplied by the hydraulics module 106. Additionally, the electronics module 108 and/or the surface control panel 24 can provide electrical power and/or control for the coring module 200.

The module 200 includes isolation/sealing elements or members that can isolate/seal an annular zone or section 118 proximate to the coring device 202. It should be appreciated that isolating a zone along the wellbore axis, rather than a localized point on a wellbore wall, increases the likelihood that formation fluid can be efficiently extracted from a formation. For instance, a wellbore wall could include laminated areas that block fluid flow or fractures that prevent an effective seal from being formed by a pad pressed on the wellbore wall. An isolated axial zone provides a greater likelihood that a region or area having favorable flow characteristics will be captured. Thus, laminated areas or fractures will be less likely to interfere with fluid sampling. Moreover, the formation could have low permeability, which restricts the flow of fluid out of the formation. Utilizing a zone can increase the flow rate of fluid into the zone and therefore reduce the time needed to obtain a pristine fluid sample.

In one embodiment, the isolation members include two or more packer elements 220 that selectively expand to isolate the annular section 118. When actuated, each packer element 220 expands and sealingly engages an adjacent wellbore wall 11 to form a fluid barrier across an annulus portion of the wellbore 12. In one embodiment, the packer elements 220 use flexible bladders that can deform sufficiently to maintain a sealing engagement with the wellbore wall 11 even though the module 200 is not centrally positioned in the wellbore 12. The fluid barrier reduces or prevents fluid movement into or out of the section 118. As will be seen below, the module 200 can cause the section 118 of the wellbore between the packer elements 220 to have a condition different from that of the regions above and below the section 118; e.g., a different pressure or contain different fluids. In one embodiment, the packer elements 220 are actuated using pressurized hydraulic fluid received via the supply line 136 from the hydraulics module 106. In other embodiments, the packer elements 220 can be mechanically compressed or actuated using moving parts, e.g., hydraulically actuated pistons. Valve elements 221 control the flow of fluid into and out of the packer elements 220. The module 200 can include a control manifold 226 that controls the operation of the packer elements 220, e.g., by controlling the operation of the valve elements 221 associated with the packer elements 220. The fluid return line 140 returns hydraulic fluid to the hydraulics module 106. While two "stacked" packers are shown, it should be understood that the present invention is not limited to any number of isolation elements. In some embodiments, a unitary isolation element could be used to form an isolated annular zone or region.

To radially displace the coring module 200, the module 200 includes upper and lower decentralizing arms 222 located on the side of the tool generally opposite to the coring bit 204. Each arm 222 is operated by an associated hydraulic system 224. The arms 222 can be mounted within the body of module 200 by pivot pins (not shown) and adapted for limited arcuate movement by hydraulic cylinders (not shown). In one embodiment, the arms 222 are actuated using pressurized hydraulic fluid received via the supply line 136 from the hydraulics module 106. The control manifold 226 controls the movement and positioning of the arms 222 by controlling the operation the hydraulic system 224, which can include valves. The fluid return line 140 returns hydraulic fluid to the hydraulics module 106. Further details regarding such devices are disclosed in U.S. Pat. Nos. 5,411,106 and 6,157,893, which are hereby incorporated by reference for all purposes.

Figure 5:
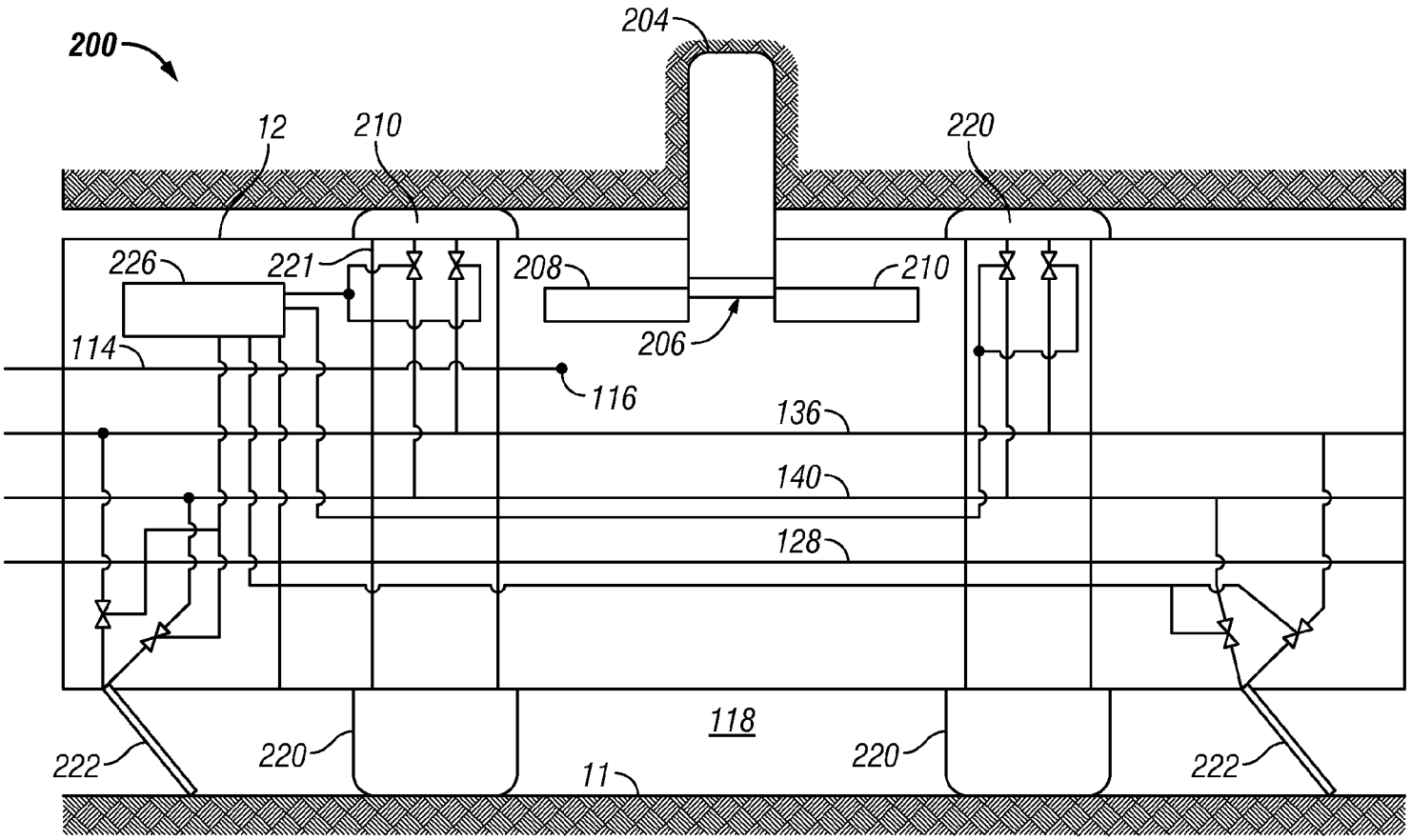
FIG. 5 schematically illustrates a coring device made in accordance with one embodiment of the present invention in a coring position.

Referring now to FIG. 5, the module 200 is shown lowered in the wellbore 12 by a conveyance device 14 to a desired depth for obtaining a core from formation 10. In FIG. 5, the coring bit 204 is shown fully deployed through the body of the module 200 to retrieve a core from the formation 10. The module 200 is locked in place against the wellbore wall 11 by arms 222. In this position, the support arms 222 radially displace the module 200 and thereby position the coring bit 204 closer to the wellbore wall 11. Additionally, the packer elements 220 are expanded into sealing engagement with the wellbore wall 11. Thus, the region 118 has been hydraulically isolated from the adjacent regions of the wellbore 12. At this point, the pressure in the region 118 can be reduced by activating the pump thru pump 132. The pump thru pump 132 pumps fluid out of the region 118, which allows formation fluid to fill the region 118. The formation fluid sampling module 112 can continuously monitor the fluid being pumped out of the region 118 using the sensors module 120. After the sensor package/module 120 shows clean formation fluid is pumped the module 200 can store one or more clean samples in the tanks 122, perform a precise drawdown using drawdown pump 134 and initiate coring. In one arrangement, the fluid is analyzed for contaminants such as drilling fluid. In many instances, it is desirable to begin coring only after the region 118 has only formation fluid. Upon being secured in this position and verifying that the region 118 is relatively clean of contaminants, the coring device 202 is energized. In one arrangement, the bit box 206 thrusts the coring bit 204 radially outward into contact with the wellbore wall 11 while a hydraulic or electric motor 208 rotates the coring bit 204. The coring bit 204 advances into the formation a predetermined distance. Because the coring bit 204 is hollow, a core sample is formed and retained within the cylindrical mandrel (not shown) during this drilling action. After the coring bit 204 reaches the limit the core is broken by tilting the bit box 206 and retracted into the body of the module. The core is stored into the core container 210 in formation fluid.

Retrieving core samples within a hydraulically isolated zone provides at least three advantages. First, because the pressure in the region 118 is reduced and the region 118 is hydraulically isolated from the remainder of the wellbore 12, coring can be done with the wellbore in an at-balance or an under-balanced condition, i.e., the fluid in the formation being approximately the same as or at a greater pressure than the fluid in the region 118. Coring in an underbalanced condition can be faster than the traditional overbalanced condition present during conventional coring operations. Second, because the region 118 is full with relatively clean formation fluid, the formation fluid sampling module 112 via line 114 and opening 116 can retrieve this clean formation fluid either before, during or after the core sample or samples have been taken. As noted above, these fluid samples can be analyzed and stored. The formation fluid sampling module 112 can also perform other tests such as a pressure profile or drawdown test. Moreover, the core samples can also be stored with this relatively clean formation fluid. Third, because coring is done with pristine formation fluid in the region 118, the risk that the coring sample is contaminated by wellbore fluids is reduced, if not eliminated. Thus, the at-balance or under-balanced condition can provide for cleaner and faster coring operations and yield higher quality samples. It should be therefore appreciated that embodiments of the present invention can provide a core that has been cut, retrieved and stored in pristine formation fluid.

Figure 6:
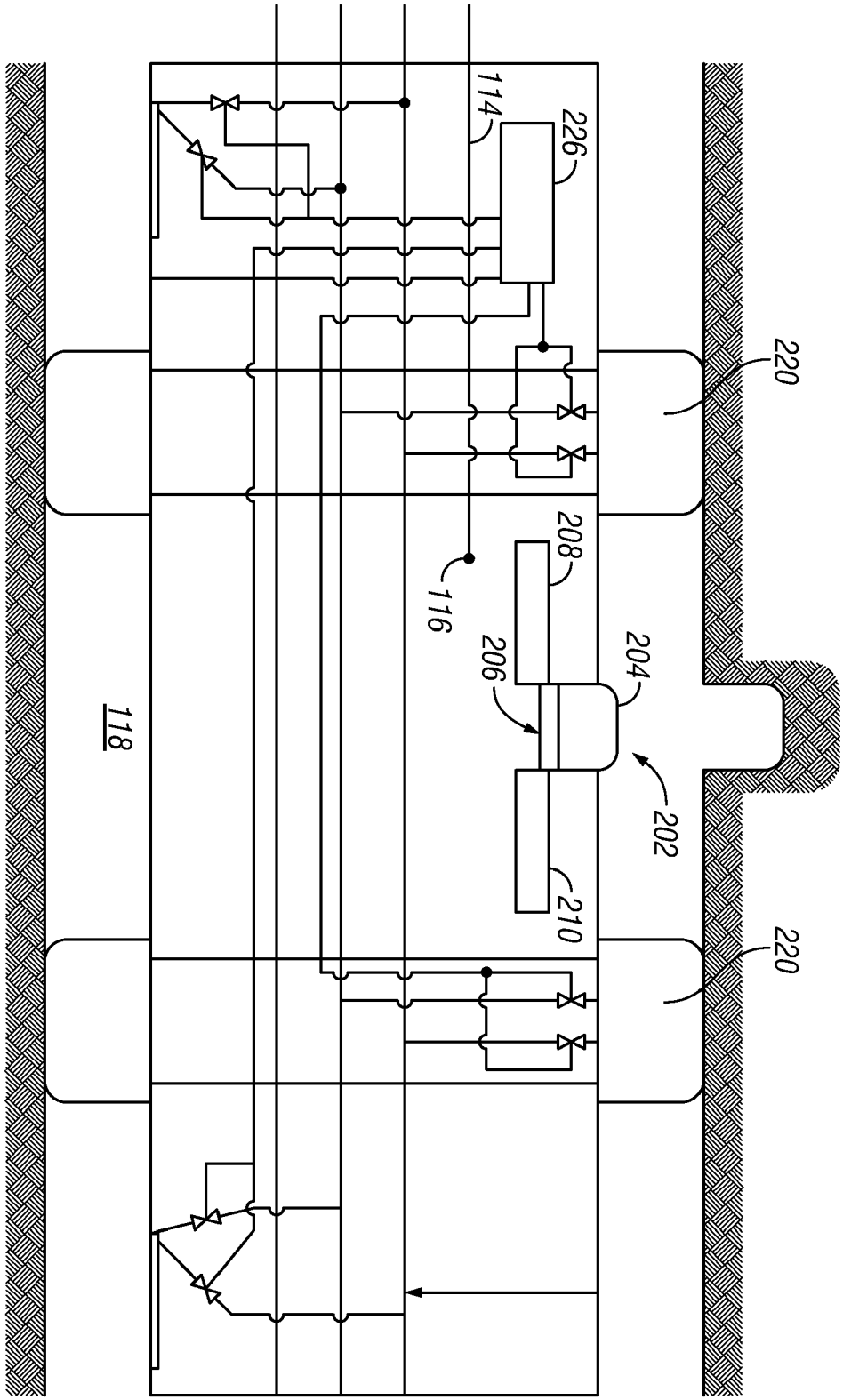
FIG. 6 schematically illustrates a coring device made in accordance with one embodiment of the present invention after retrieving a core sample.

Referring, now to FIG. 6, after the core is obtained, the coring bit 204 is retracted into the body of module 200 and the core is stored into the core container 210 in formation fluid and the decentralizing arms 222 are also retracted into the body of module 200. The module 200 may then be raised and removed from the wellbore 12 by the wireline 14 and the core retrieved from the module 200 for analysis. Additionally, one coring device 202 can be utilized to obtain multiple coring samples, each of which are saved in a chamber in an isolated or separated manner.

As noted previously, aspects of the present invention enable the collection of pristine core samples from a formation of interest. Embodiments described above provide core samples retrieved in uncontaminated formation fluid. In conjunction with or independent of such embodiments, aspects of the present invention also enable the extraction of core samples from a greater depth from a wall of a wellbore. For instance, exemplary embodiments of the present invention include a coring bit that utilizes multiple stages for penetrating into a formation. As will become apparent from the discussion below in connection with FIGS. 4 and 7-9, the use of two or more coring stages increases the depth of penetration into a formation and thereby increases the likelihood of retrieving a higher quality, non-contaminated core.

As previously discussed, FIG. 4 schematically shows an embodiment of a coring module 200 that retrieves core samples from the formation. The coring module 200 uses a coring device 202 for extracting the core sample and a bit drive 208 for rotating the coring bit. The bit box 206 advances the coring bit 204 out of a tool body 205 and into the formation as well as retracts the coring bit 204 at least partially into the tool body 205.

Figure 7:
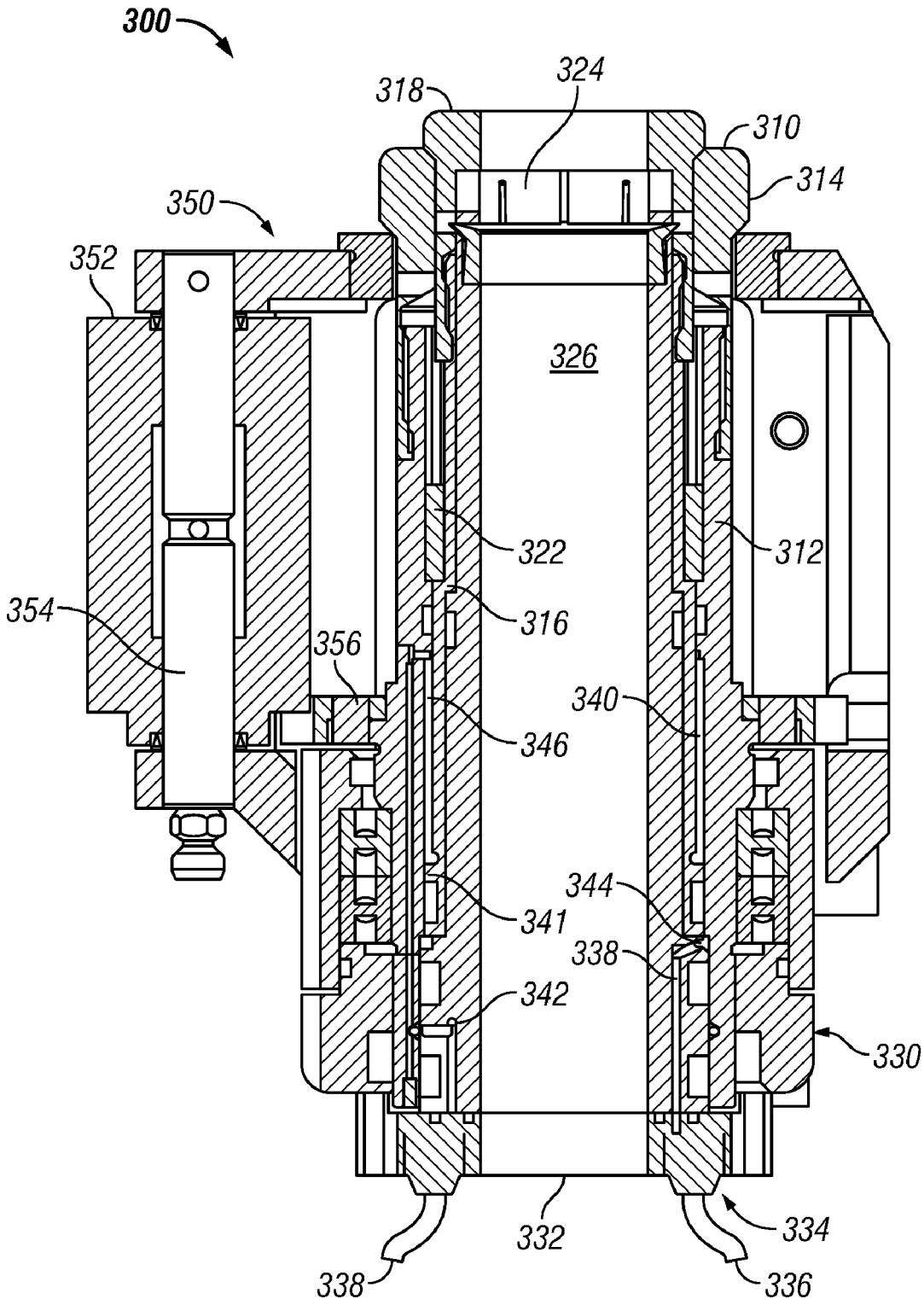
FIG. 7 schematically illustrates an expandable coring bit made in accordance with one embodiment of the present invention in a retracted position.

Referring now to FIG. 7, in other embodiments, the coring device 300 includes an expandable bit 310 that cuts and retrieves core samples and a drive device 330 that selectively extends and rotates the expandable bit 310.

The expandable bit 310 uses multiple coring elements to retrieve core samples. Each coring element is configured to bore a preset distance into a formation. In one arrangement, the expandable bit 310 includes an outer mandrel 312 having a primary bit 314 and an inner mandrel 316 having a secondary bit 318. The outer mandrel 312, and the inner mandrel 316 have a sliding telescopic relationship with the inner mandrel 316 being positioned within the outer mandrel 312. A locking member 322 prevents relative rotation between the inner mandrel 316 and the outer mandrel 312, but allows the inner mandrel 316 to slide or translate relative to the outer mandrel 312. Due to the locking member 322, rotating the outer mandrel 312 will cause the inner mandrel 316 to also rotate. In the FIG. 7 embodiment, the primary and secondary bit 314, 318 cooperatively bore a first depth into the formation and the secondary bit 318 by itself bores a second further depth into the formation. Other devices such as a core catcher 324 for automatically grip the core during bit retraction can also be included. The core is captured within a bore 326.

The drive device 330 selectively advances the outer and inner mandrels 312 and 316 into the formation of interest. In one arrangement, the drive device 330 includes a bit box 332 that is extended and retracted by a mechanical-hydraulic system. Such a system is schematically illustrated in FIG. 4 for extending and retracting the bit box 206. Like the bit box 206, the bit box 332 provides lateral movement with respect to the longitudinal axis of the module 200. Extension of the bit box 332 pushes the primary bit 314 and the secondary bit 318 into the formation a first distance or depth. A suitable system can utilize known hydraulically actuated pistons and will not be discussed in further detail. Of course, other devices using mechanical or electro-mechanical translation devices can also be utilized.

The drive device 330 also includes an actuating device 334 that selectively extends and retracts the inner mandrel 316 and secondary bit 318 into the formation. In one embodiment, the actuating device 334 includes a first hydraulic actuator 336 for advancing the inner mandrel 316, a second hydraulic actuator 338 for retracting the inner mandrel 316, and a pressure chamber 340. A piston head 341 formed on the inner mandrel 316 divides the pressure chamber 340 into two opposing sections 344, 346. The first hydraulic actuator 336 conveys pressurized hydraulic fluid via suitable line 338 into the first section 344. The pressure in the section 344 urges the inner mandrel 316 radially outward. The second hydraulic actuator 338 conveys pressurized hydraulic fluid via a suitable line 342 into the second section 346, the resulting pressure increase urging the inner mandrel 316 radially inward. The first and second hydraulic actuators 336, 338 can include suitable valves (not shown) to allow fluid to enter and leave the pressure chamber 340. The hydraulic fluid can be supplied via a suitable source such as the hydraulics module 106 (FIG. 2). It should be understood that the device for advancing and retracting the inner mandrel 312 is not limited to hydraulic devices. Other devices using electric motors or pneumatic power can also be utilized.

A number of systems can be used to control the advancement and retraction of the primary bit 314 and the secondary bit 318. In some embodiments, a sensor (not shown) can be used to measure a selected parameter that indicates the position of the primary bit 314 and/or the secondary bit 318; e.g., to indicate whether the secondary bit 318 has completed a full radially outward stroke into the formation. Such an indication can be used to initiate the retraction of the primary bit 314 and/or the secondary bit 318. In one arrangement, the first hydraulic actuator 336 can include a pressure sensor (not shown) that sense a peak pressure that occurs as the inner mandrel 316 and the secondary bit 318 reach the end of the stroke. A control unit (e.g., the electronics module 108 of FIG. 2) can use the measurement of the pressure sensor (not shown) to actuate the appropriate valves to bleed fluid from the first hydraulic actuator 336 and to energize the second hydraulic actuator 338 with pressurized fluid. Other pressure sensors can be positioned in the second hydraulic actuator 338 or elsewhere to further control operations. In other embodiments, mechanical trip switches can be positioned at the ends of the stroke of the inner mandrel to actuate the first and the second hydraulic actuators 336, 338. In still other embodiments, a timer can be used to initiate the extension and retraction of the primary and secondary bits 314, 318. It should be understood that these control systems are intended to be non-limited examples and that any form of control, whether mechanical, electrical, hydraulic, or electronic can be used.

Figure 8:
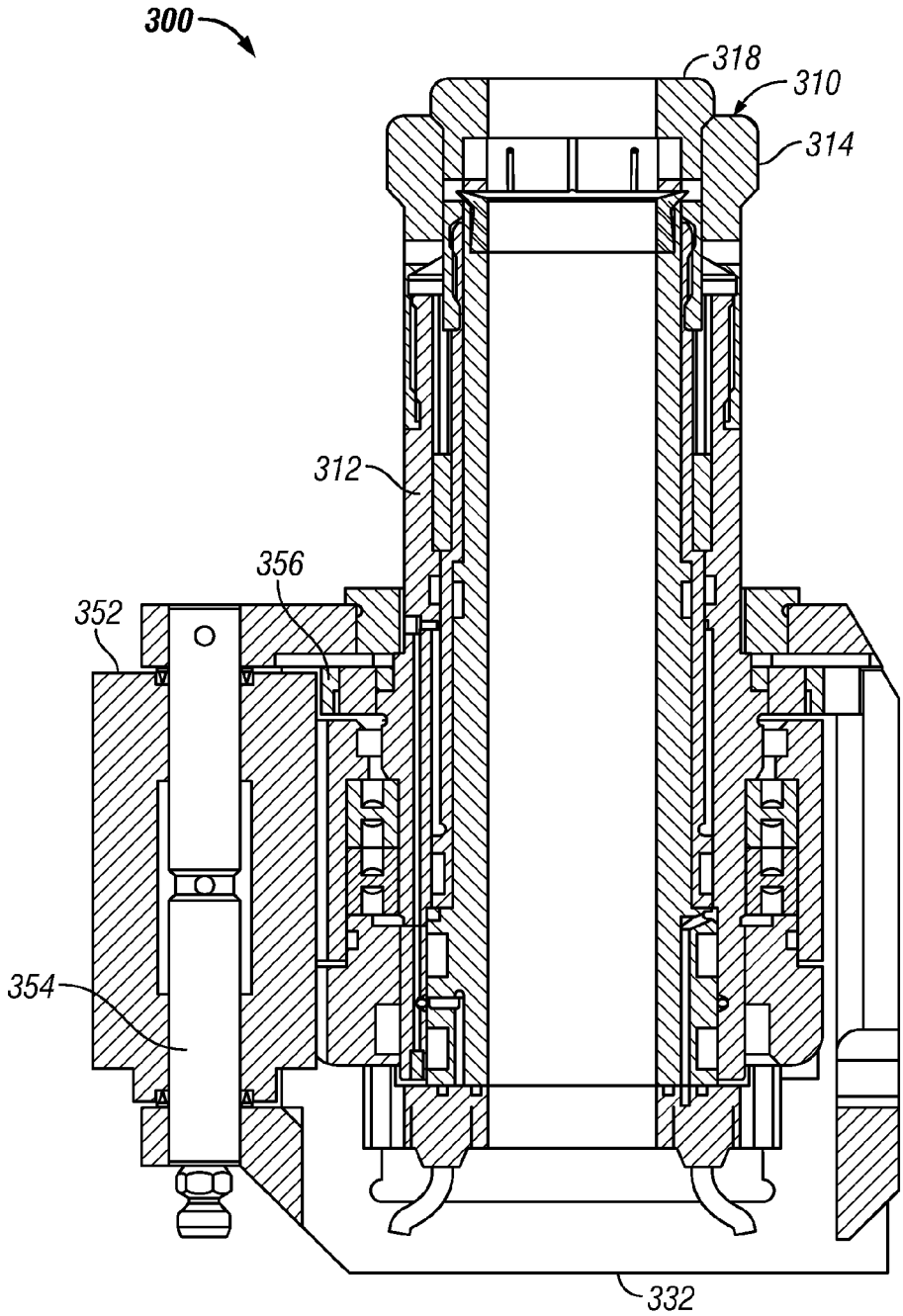
FIG. 8 schematically illustrates an expandable coring bit made in accordance with one embodiment of the present invention in a partially extended position.

The drive device 330 also includes a rotary power transmission system 350 that rotates the primary bit 314 and secondary bit 318 via the outer mandrel 312 and outer mandrel 316, respectively. In one arrangement, the rotary power transmission system 350 includes a gear element 352 connected via a shaft 354 to a rotary drive source (not shown) such as an electric motor. The gear element 352 meshes with teeth 356 formed on an outer surface of the outer mandrel 312. The teeth 356 can be integral with the outer mandrel 312 or formed on an annular ring or collar connected to the outer mandrel 312. In the embodiment shown, the transmission system 350 has a relatively fixed relationship to a tool body 205 (FIG. 4) whereas the bit box 332 translates radially inward and outward out of the tool body 205 (FIG. 4). To maintain a meshed relationship between the gear element 352 and the teeth 356, the gear element 352 has a length that is roughly the same as the stroke of the outer mandrel 312 as it extends out of the tool body 205 (FIG. 4). As shown in FIG. 7, the gear teeth 356 are positioned at a radially inward position on the gear element 352. In FIG. 8, the gear teeth 356 have slid radially along the gear element 352 and stopped at the radially outward position on the gear element 352.

As discussed previously, exemplary drive motors (not shown) for rotating the coring bit 310 can include a high torque, high speed DC motor or a low speed high torque hydraulic motor and can include suitable gearing arrangements for gearing up or down the drive speed. The coring device 300 can utilize a self-contained power system, e.g., a hydraulically actuated motor, and/or utilize the hydraulic fluid supplied by the hydraulics module 106 (FIG. 3).

Certain embodiments of the present invention can utilize variable positioning of the tool 300 in the wellbore. For example, embodiments can be configured to have a controllable radial position in the wellbore, which then controls the depth of penetration of the coring device 310. As discussed previously in connection with FIG. 4, the module 200 includes upper and lower decentralizing arms 222 that radially displace the coring module 200. In some applications, it may be desirable to position the module 300 eccentric in the wellbore but not pressed into contact against the wellbore wall. Thus, in some embodiments, a controller, such as the electronics module 108 (FIG. 2), via the control manifold 226 can be programmed to control the radial extension of each arm 222. The control unit can also control the pressure in the packer elements 220 (FIG. 3). By controlling the positioning of the arms 222 and the pressure applied to the packer elements 220, the coring module 200 can be positioned at any selected radial position in the wellbore. That is, the coring module 200 can be positioned concentric in the wellbore, fully displaced against a wellbore wall, or any intermediate radial position.

Figure 9:
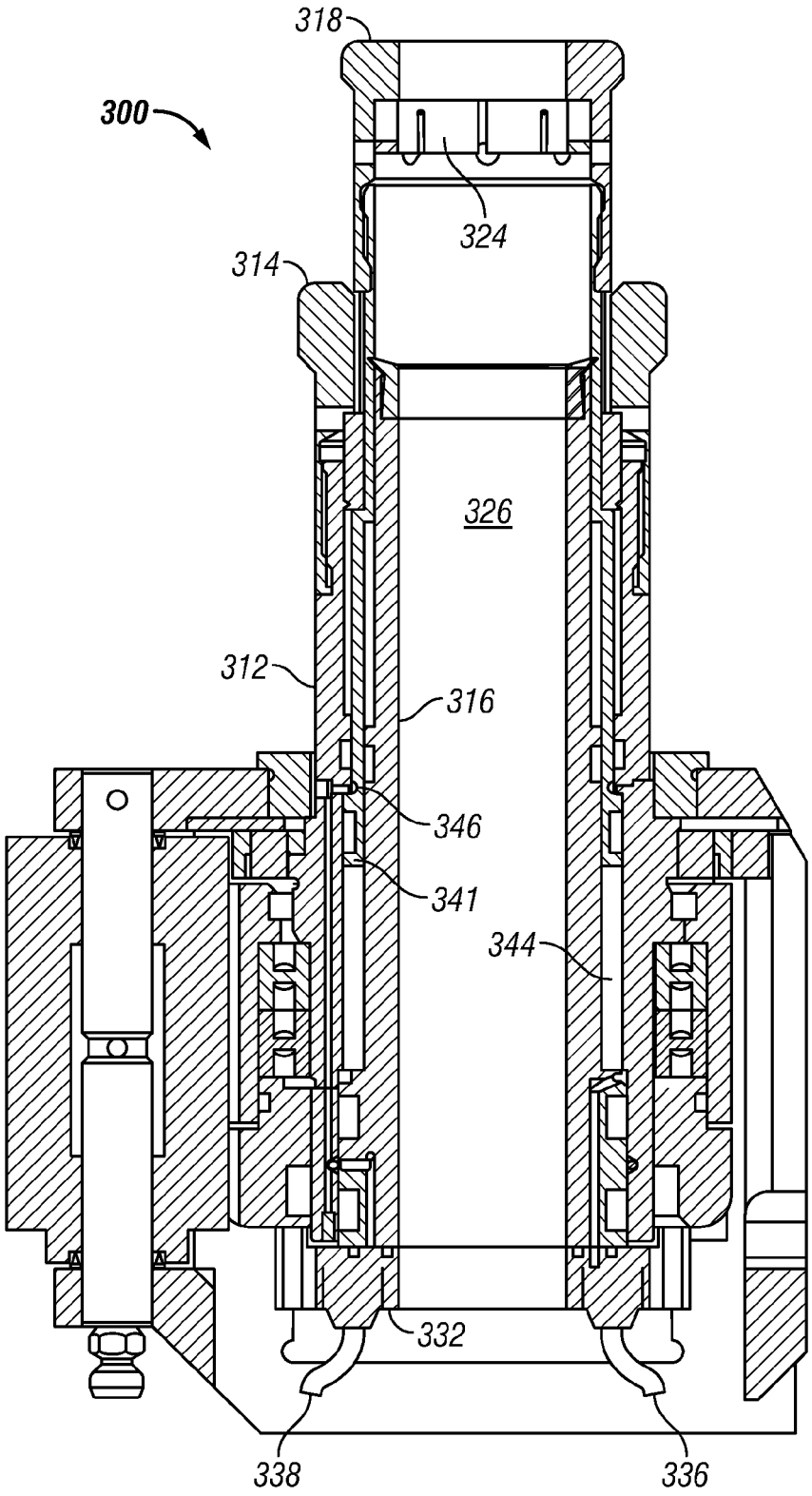
FIG. 9 schematically illustrates an expandable coring bit made in accordance with one embodiment of the present invention in a fully extended position.

The operation of the tool will be discussed with reference to FIGS. 7-9. In FIG. 7, the coring device 300 is shown in a fully retracted position. The inner mandrel 316 is positioned substantially inside the outer mandrel 312 and the secondary bit 318 is positioned proximate to the primary bit 314. As discussed above, the coring device 300 can be positioned centrally in the wellbore, positioned against the wellbore wall as shown in FIG. 5, or positioned in an intermediate radial position. The selected radial position can depend, in part, on the desired depth of penetration into the formation. Referring now to FIG. 8, once the coring device has been positioned adjacent a formation of interest, the rotary drive (not shown) rotates the gear element 352 via the shaft 354. The gear element 352, in turn, rotates the outer mandrel 312 due to the meshed contact with the gear teeth 356. As noted previously, rotation of the outer mandrel 312 causes both the primary bit 314 and the secondary bit 318 to rotate. With the primary and secondary bits 314, 318 rotating, the bit box 332 advances radially outward toward the formation. The rotating bits 314, 318 cut into the formation until the outer mandrel 312 completes its stroke. Referring now to FIG. 9, upon the outer mandrel 312 completing its stroke, the control unit (e.g., electronics 108) or hydraulic switches energizes the first hydraulic actuator 336 to apply pressurized hydraulic fluid to the chamber section 344. The pressure applied to the piston head 341 urges the inner mandrel 316 radially outward; at the same time the hydraulic actuator 338 is connected to return line to allow the oil from chamber 346 to return to pressure compensator of the hydraulic system (not shown). Once the inner mandrel 316 reaches the limit of its stroke, the control unit de-energizes the first hydraulic actuator 336, the core is broken by tilting the bit box and energizes the second hydraulic actuator 338 to apply pressurized hydraulic fluid to the chamber section 346. The pressure applied to the piston head 341 urges the inner mandrel 316 radially inward; at the same time the hydraulic actuator 336 is connected to return line to allow the oil from chamber 344 to return to tank. As the inner mandrel 316 retracts, the core catcher 324 retains the core sample in the bore 326. When the inner mandrel 316 and bit box 332 fully retract, the coring tool 300 returns to the position shown in FIG. 7.

It should be appreciated that the extension of the inner mandrel 316 and secondary bit 318 from the outer mandrel 318 provides a core of greater length that would otherwise be obtained. In addition to retrieving a greater quantity of sample, the coring device 300 provides a core sample of greater quality because the sample has been taken from a location distal from the wellbore wall, which can contain contaminants. While only two drill bits have been discussed, it should be appreciated that three or more drill bits can also be utilized. Furthermore, in some variants, a single drill bit can be utilized in conjunction with two or more mandrels. For example, an inner mandrel of two or more telescoping mandrels can include the single drill bit that is incrementally advanced into the wellbore as the mandrels telescopically project into a formation.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. An apparatus for retrieving one or more samples from a wellbore drilled in a subterranean formation, the apparatus having a longitudinal axis, the apparatus comprising:

a coring device retrieving at least one core from a wall of the wellbore;

a first bit associated with the coring device drilling a first depth into the formation;

a second bit associated with the coring device, the second bit configured to extend from the first bit, the second bit drilling a second depth into the formation, the first bit and the second bit being configured to move laterally relative to the longitudinal axis; and a conveyance device configured to convey the coring device into the wellbore.

2. The apparatus of claim 1 further comprising a first mandrel receiving the first bit and a second mandrel receiving the second bit.

3. The apparatus of claim 2 wherein the first mandrel and the second mandrel have a telescopic relationship.

4. The apparatus of claim 1 further comprising an actuating device configured to radially translate the second bit.

5. The apparatus of claim 1 further comprising a rotary drive rotating the first and the second bit.

6. The apparatus of claim 1 further comprising a drive device extending the first bit and the second bit a first depth into the formation and extending only the second bit a second depth into the formation, wherein the second depth is greater than the first depth, the drive device being configured to extend the first bit and the second bit radially relative to a wellbore axis.

7. An apparatus for retrieving one or more samples from a wellbore drilled in a subterranean formation, comprising:

a coring device retrieving at least one core from a wall of the wellbore;

a first bit associated with the coring device drilling a first depth into the formation;

a second bit associated with the coring device drilling a second depth into the formation; and an actuating device translating the second bit, wherein the actuating device includes a first hydraulic actuator applying pressure to extend the second bit into the formation and a second hydraulic actuator applying pressure to retract the second bit from the formation.

8. An apparatus for retrieving one or more samples from a wellbore drilled in a subterranean formation, comprising:

a coring device retrieving at least one core from a wall of the wellbore;

a first bit associated with the coring device drilling a first depth into the formation;

a second bit associated with the coring device drilling a second depth into the formation; and at least one isolation member substantially isolating an annular region proximate to the coring device; and a flow device flowing a fluid out of the isolated region to form one of: (i) an at-balanced condition, and (ii) an underbalanced condition.

9. A method for taking one or more samples from a subterranean formation, comprising:

conveying a sampling tool having a first coring bit and a second coring bit into a wellbore intersecting the formation, the sampling tool having a longitudinal axis;

drilling a first depth into the formation with the first coring bit, the first coring bit moving laterally relative to the longitudinal axis;

drilling a second depth into the formation with the second coring bit by extending the second coring bit from the first coring bit; and retrieving at least one core from the formation.

10. The method of claim 9 further comprising positioning the first bit on a first mandrel and positioning the second bit on a second mandrel.

11. The method of claim 9 further translating the second bit comprising with an actuating device.

12. The method of claim 11 wherein the translating is done by applying pressure to extend the second bit into the formation and applying pressure to retract the second bit from the formation.

13. The method of claim 9 further comprising:

determining a selected total depth for drilling into a formation;

positioning the coring device radially in the wellbore to drill to the selected total depth.

14. A method for taking one or more samples from a subterranean formation, comprising:

conveying a sampling tool having a first coring bit and a second coring bit into a wellbore intersecting the formation, the sampling tool having a longitudinal axis;

positioning the first bit on a first mandrel and positioning the second bit on a second mandrel; and telescopically arranging the first mandrel and the second mandrel such that the first coring bit and the second coring bit move laterally relative to the longitudinal axis;

drilling a first depth into the formation with the first coring bit;

drilling a second depth into the formation with the second coring bit; and retrieving at least one core from the formation.

15. A method for taking one or more samples from a subterranean formation, comprising:

conveying a sampling tool having a first coring bit and a second coring bit into a wellbore intersecting the formation, the wellbore having a wellbore axis;

drilling a first depth into the formation with the first coring bit by moving the first coring bit radially relative to the wellbore axis;

drilling a second depth into the formation with the second coring bit by moving the second coring bit radially relative to the wellbore axis;

rotating the first and the second bit with a rotary drive;

retrieving at least one core from the formation.

16. A method for taking one or more samples from a subterranean formation, comprising:

conveying a sampling tool having a first coring bit and a second coring bit into a wellbore intersecting the formation the wellbore having a wellbore axis;

drilling a first depth into the formation with the first coring bit by moving the first coring bit radially relative to the wellbore axis;

drilling a second depth into the formation with the second coring bit by moving the second coring bit radially relative to the wellbore axis;

retrieving at least one core from the formation; and extending the first bit and the second bit a first depth into the formation and extending only the second bit a second depth into the formation, wherein the second depth is greater than the first depth.

17. A method for taking one or more samples from a subterranean formation, comprising:

conveying a sampling tool having a first coring bit and a second coring bit into a wellbore intersecting the formation;

drilling a first depth into the formation with the first coring bit;

drilling a second depth into the formation with the second coring bit;

retrieving at least one core from the formation; and isolating an annular regional proximate the coring device and drawing fluid out of the isolated region to form one of (i) an at-balanced condition, and (ii) an underbalanced condition.

18. A method for taking one or more samples from a subterranean formation, comprising:

retrieving a formation fluid from the subterranean formation and into an isolated zone of a wellbore; and retrieving at least one core sample from the subterranean formation by:

(i) drilling a first depth into the formation with a first coring bit; and (ii) drilling a second depth into the formation with a second coring bit.

19. The method of claim 18 further comprising storing the at least one core sample in the formation fluid.

20. The method of claim 18 further comprising storing a sample of the formation fluid.

* * * * *